United States Patent [19]

Fishman

[11] 4,223,800

[45] Sep. 23, 1980

[54] REFRIGERATOR CONTAINER

[75] Inventor: Aaron H. Fishman, Hewlett Harbor, N.Y.

[73] Assignee: APL Corporation, Great Neck, N.Y.

[21] Appl. No.: 67,653

[22] Filed: Aug. 17, 1979

[51] Int. Cl.[2] ..... B65D 43/04; B65D 43/08

[52] U.S. Cl. ..... 220/352; 150/0.5

[58] Field of Search ..... 220/352, 356; 150/0.5

[56] References Cited

U.S. PATENT DOCUMENTS

| | | | |
|---|---|---|---|
| 2,950,813 | 8/1960 | Koones | 220/352 X |
| 3,557,998 | 1/1971 | Collie | 150/0.5 |

*Primary Examiner*—George T. Hall

*Attorney, Agent, or Firm*—Caesar, Rivise, Bernstein & Cohen, Ltd.

[57] ABSTRACT

A refrigerator container for food. The container includes a receptacle portion comprising a plastic which is resistant to flexing and a lid for sealing the container. The lid has an inflexible portion which comprises a material having the same shrink properties as the receptacle and a resilient portion, the inflexible portion including a peripheral flange which extends parallel to the inner surface of the mouth of the receptacle portion, the outer surface of the peripheral flange being substantially the size of but slightly smaller than the inner surface of the mouth of the receptacle portion. The resilient portion of the lid includes a peripheral flange that fits about and closely adjacent the outer surface of the peripheral flange of the inflexible portions so that when the lid is used to close the container there is a tight fit between the lid and the mouth of the receptacle as the flange of the inflexible portion is urged against the flange of the resilient portion. The inflexible portion of the lid has the same shrink characteristics as the receptacle portion so that a tight fit between the lid and the receptacle at room temperature remains tight when the container is placed in a refrigerator.

6 Claims, 3 Drawing Figures

REFRIGERATOR CONTAINER

This invention relates generally to refrigerator containers and more particularly to a refrigerator container having a lid which fits tightly upon the receptacle portion of the container, irrespective of the temperature of the environment in which the container is placed.

Food containers comprised of a receptacle portion which is transparent and made of a plastic which is resistent to flexing typically include lids which are formed of two materials, a first material which is substantially of the same composition as that of the receptacle portion and a resilient portion which is used to make a tight fit between the lid and the receptacle thus closing the contents of the receptacle from the atmosphere. However, the prior containers of the type specified above have a problem in that the construction of the lid is such that the resilient portion has a different temperature shrink characteristic than that of the receptacle and thus when the container is placed in a refrigerator there is a larger shrinkage of the resilient portion of the lid than the mouth of the container. This causes a breaking of the seal between the lid and the container thereby allowing spoilage, as well as the escape of vapors from the container.

It is therefore an object of this invention to overcome the aforementioned disadvantage of prior art containers.

Another object of the invention is to provide a new and improved lid for a container which is useable in a refrigerator and which maintains a tight seal between the lid and the receptacle portion of the container.

Another object of the invention is to provide a new and improved container having a lid which is tightly fit into the receptacle portion irrespective of temperature and which is as attractive as prior art containers.

These and other objects of the invention are achieved by providing a refrigerator container for food which includes a receptacle portion which comprises a plastic which is resistant to flexing and a lid for sealing the container. The lid has an inflexible portion which comprises a material having the same shrink properties as the receptacle and a resilient portion. The inflexible portion includes a peripheral flange which extends parallel to the inner surface of the mouth of the receptacle portion. The outer surface of the peripheral flange is substantially the size of but slightly smaller than the inner surface of the mouth of the receptacle portion. The resilient portion of the lid includes a peripheral flange that fits about and closely adjacent the outer surface of the peripheral flange of the inflexible portion so that when the lid is used to close the container there is a tight fit between the lid and the mouth of the receptacle as the flange of the inflexible portion is urged against the flange of the resilient portion which is in tight contact with the mouth of the receptacle portion. The inflexible portion of the lid has the same shrinking characteristics as the receptacle portion so that a tight fit between the lid and the receptacle at room temperature remains tight when the container is placed in the refrigerator.

Other objects and many of the attendant advantages of this invention will be readily appreciated as the same becomes better understood by reference to the following detailed description when considered in connection with the accompanying drawing wherein.

Figure 1:
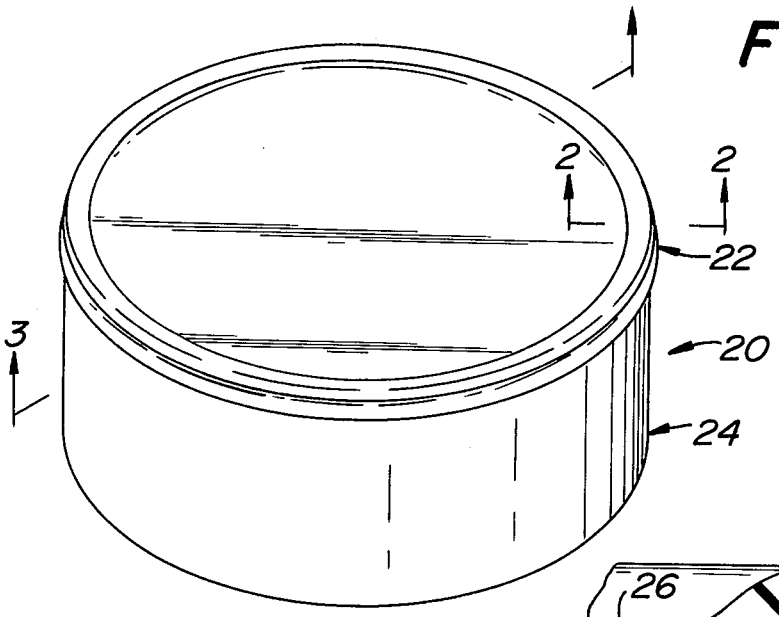
FIG. 1 is a perspective view of a container embodying the invention.

Referring now in greater detail to the various figures of the drawing wherein like reference numerals refer to like parts, a container embodying the invention is shown generally at 20 in FIG. 1. Container 20 includes a lid 22 and a receptacle 24.

It should be noted that the container 20 shown in FIG. 1 embodying the invention is of a cylindrical shape, but the principle of this invention applies as well to other shapes of containers such as rectangular and oval shapes.

Figure 2:
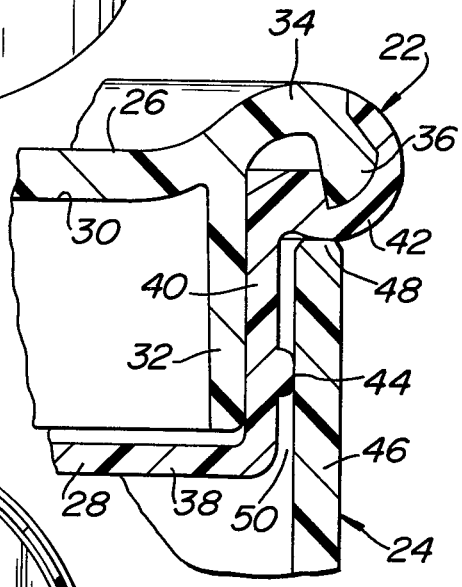
FIG. 2 is an enlarged fragmentary sectional view taken along the line 2—2 in FIG. 1.
Figure 3:
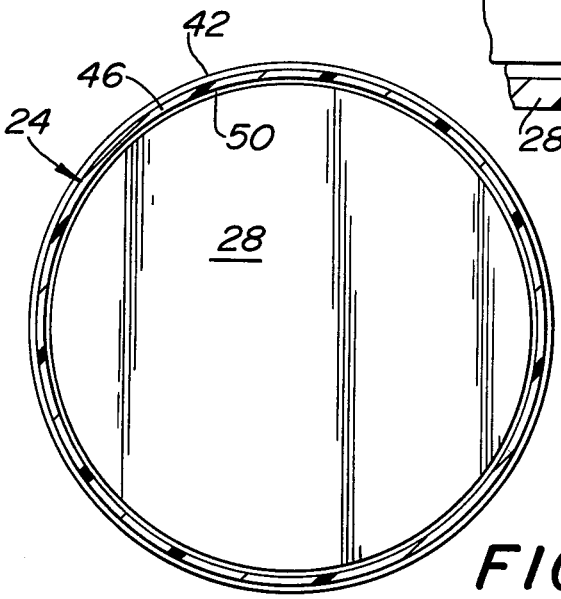
FIG. 3 is a sectional view taken along line 3—3 in FIG. 1.

As best seen in FIG. 2 the lid 22 basically comprises a top portion 26 and a bottom portion 28. The top portion 26 includes a planar circular top wall 30, a depending flange 32 that extends around the entire periphery of wall 30, a laterally extending flange 34 which is of generally C-shaped cross-section, and which extends around the entire periphery of wall 30. Flange 34 is integral with flange 32 and top wall 30.

The top portion 26 of the lid is preferably comprised of plastic comprising polyacrylonitrile resins which makes the plastic resistant to temperature, chemicals, impact and flexing.

The peripheral flange 32, as will hereinafter be seen in greater detail, extends parallel to the inner surface of the mouth of the receptacle portion 24 when the lid is placed on the receptacle. The outer surface of the peripheral flange 32 is substantially the same size, but slightly smaller than the inner surface of the mouth of the receptacle portion.

The peripheral flange 34 of the top portion 36 includes an enlarged portion 36 which, as will hereinafter be seen, is adapted to mate with a receiving portion of the bottom portion 28 of the lid.

The bottom portion of the lid includes a circular flat wall 38 which forms the bottom wall of the lid. Portion 28 also includes an upstanding annular flange 40 which extends about the periphery of the wall 38. A laterally extending flange 42 which is of C-shaped cross-section is integral with the upper end of the flange 40 and the inner surface of the C-shaped section 42 of the flange and extends along the entire length of the flange 40. The flange 42 is adapted to receive the enlarged section 36 of the flange 34.

The top portion 26 and the bottom portion 28 are assembled together to form lid 22 by the insertion of the peripheral flange 32 of the top portion within flange 40 and the portion 36 of flange 34 of the top portion is inserted into the track formed by the C-sectioned flange 42. When assembled together, the flanges 34 and 36 have a smooth semi-circular outer surface which is aesthetically pleasing and which forms a laterally extending flange to facilitate opening and closing of the container.

The bottom portion 28 of the lid is preferably comprised of a resilient plastic such as polyethylene and includes a bead 44 which extends annularly about the outer surface of the flange 40. The bead acts to form a sealed closure when the lid 22 is placed on receptacle 24.

The receptacle 24 includes a cylindrical side wall 46. The upper end 48 of the wall 46 forms a mouth of the receptacle. The inner surface 50 of the wall 46 at the top end 40 of the receptacle extends parallel to the flanges 32 and 40 of the lid 22.

When the lid 22 is inserted into the mouth of the receptacle 24, the bottom portion 28 of the lid makes contact with the inner surface 50 of the mouth of the receptacle 24 as the bead 44 of the flange 40 makes contact with the inner surface of the mouth of the receptacle 24.

As seen in FIG. 2 there is little space between the flange 40 and flange 32. When the bead 44 of flange 40 engages the inner surface of the mouth of receptacle 24, the flange 40 is urged inwardly until it engages flange 32 which stops further reduction of the diameter of flange 40. Bead 44 is thus deformed as it is pressed against surface 50 to create an airtight seal between the lid and receptacle.

The receptacle 24 of the container is also preferably comprised of a plastic comprising polyacrylonitrile resins which is resistant to temperature, chemicals, impact and flexing. It should be understood that other plastics which are similarly resistant to temperature, chemicals, impact and flexing may be used.

Because the top portion 26 of the lid and the receptacle 24 are of the same composition the shrinkage characteristics of both are similar so that when the container is placed in a cooler atmosphere, the shrinkage of the diameter of the bottom portion 28 of the lid 22 is limited by flange 32 since flange 40 of the bottom portion 28 cannot shrink beyond a tight embracing of the flange 32. Thus, the seal between the bead 44 and the inner surface of the mouth of container 24 remains tight even though the temperature of the environment in which the container is placed changes considerably.

It can therefore be seen that a new and improved container has been provided. The lid of the container may be tightly sealed by use of a bottom portion which includes a resilient material for making contact with the mouth of the receptacle while retaining the attractive characteristics of the inflexible plastics such as those made from the polyacrylonitrile resins. In addition, the receptacles can be transparent yet the sealing capability of the lid with respect to the receptacle is not affected.

Without further elaboration the foregoing will so fully illustrate my invention that others may, by applying current or future knowledge, readily adapt the same for use under various conditions of service.

What is claimed as the invention is:

1. A container for food, said container including a receptacle portion comprising a material which is resistant to flexing and a lid for sealing the container, said lid having a first portion which comprises a material resistant to flexing and a resilient portion, said first portion including a peripheral flange which extends parallel to the inner surface of the mouth of said receptacle portion, the outer surface of said peripheral flange being substantially the size of, but slightly smaller than the inner surface of the mouth of said receptacle portion, said resilient portion of said lid including a band that fits around the outer surface of the peripheral flange of said inflexible portion so that when said lid is used to close said container there is a tight fit between said lid and the mouth of said receptacle as said band of said resilient portion is in tight contact with the mouth of said receptacle portion, said first portion of said lid having the same shrinking characteristics as the receptacle portion so that a tight fit between the lid and the receptacle at room temperature remains tight when the container is placed in a cooler atmosphere.

2. The container of claim 1 wherein said first portion of said lid includes a planar top portion which extends substantially over the entire top of the container.

3. The container of claim 2 wherein said resilient portion of said lid includes a planar bottom portion which forms the bottom of said lid.

4. The container of claim 1 wherein said band of said resilient portion of said lid includes an annular bead on the outer surface of said band which makes contact with the mouth of said receptacle portion, said bead being deformed as it is urged into the receptacle portion to form a tight seal when the lid is placed on the receptacle.

5. The container of claim 1 wherein said receptacle portion is comprised of a transparent material.

6. The container of claim 1 wherein said band of said resilient portion is substantially the same diameter as said flange of said first portion but slightly larger, said band being limited in the amount of its reduction as a result of cooling by the abutment thereof against said flange of said first portion.

* * * * *